United States Patent [19]

Morelli

[11] Patent Number: 4,850,747

[45] Date of Patent: Jul. 25, 1989

[54] TRENCH BOX

[76] Inventor: Aldo Morelli, 25 Rockwood Ter., Jamaica Plain, Mass. 02130

[21] Appl. No.: 202,504

[22] Filed: Jun. 6, 1988

[51] Int. Cl.[4] ..... E02D 17/08

[52] U.S. Cl. ..... 405/283; 405/272

[58] Field of Search ..... 405/272, 282, 283, 133, 405/149, 150, 258

[56] References Cited

U.S. PATENT DOCUMENTS

| | | | |
|---|---|---|---|
| 3,782,126 | 1/1974 | Pavese | 405/282 |
| 4,033,138 | 7/1977 | Griswold | 405/283 |
| 4,090,365 | 5/1978 | Nieber | 405/282 |
| 4,145,891 | 3/1979 | Krings | 405/282 |
| 4,659,260 | 4/1987 | Morelli | 405/283 |

*Primary Examiner*—David H. Corbin

*Attorney, Agent, or Firm*—Robert T. Gammons

[57] ABSTRACT

A trench box wherein there are spaced, parallel side wall panels between which there are spacer panels and wherein the upper longitudinal edges of the side wall panels and spacer panels are transversely inclined.

6 Claims, 2 Drawing Sheets

TRENCH BOX

BACKGROUND OF THE INVENTION

In my U.S. Pat. No. 4,659,260, there is shown a trench box comprised of spaced, parallel side walls and end walls pivotally connected to the ends of the side walls for holding the side walls in spaced, parallel relation. The upper longitudinal edges of the side walls and end walls are flat and, as a consequence, when the trench box is disposed in a trench with the upper longitudinal edges below ground level, it often happens that large rocks fall from the sides of the trench onto the upper edges where they accumulate together with loose dirt in considerable amounts. The buildup of rock and dirt poses the possibility of serious injury to persons working within the trench box. It is the purpose of this invention to so construct the trench box as to minimize the accumulation of rocks and dirt at the upper edges of the side walls and end walls so that it descends to the outer or inner side without accumulating on the upper edges.

SUMMARY OF THE INVENTION

As herein illustrated, the trench box according to this invention comprises spaced, parallel, longitudinally-extending side wall panels of rectangular configuration, and transversely-disposed end wall panels in the form of spacer panels disposed between the side wall panels holding the side wall panels spaced apart in parallel relation, characterized in that the upper edges of the side wall panels and the spacer panels are inclined. Preferably, the upper edges are inclined downwardly and outwardly in opposite directions, that is, of transverse, A-shaped cross section. Optionally, the upper edges may be inclined outwardly or inwardly. Alternatively, the upper edges of the side wall panels and end wall panels are of arcuate transverse cross section.

The invention will now be described in greater detail with reference to the accompanying drawings, wherein.

Figure 1:
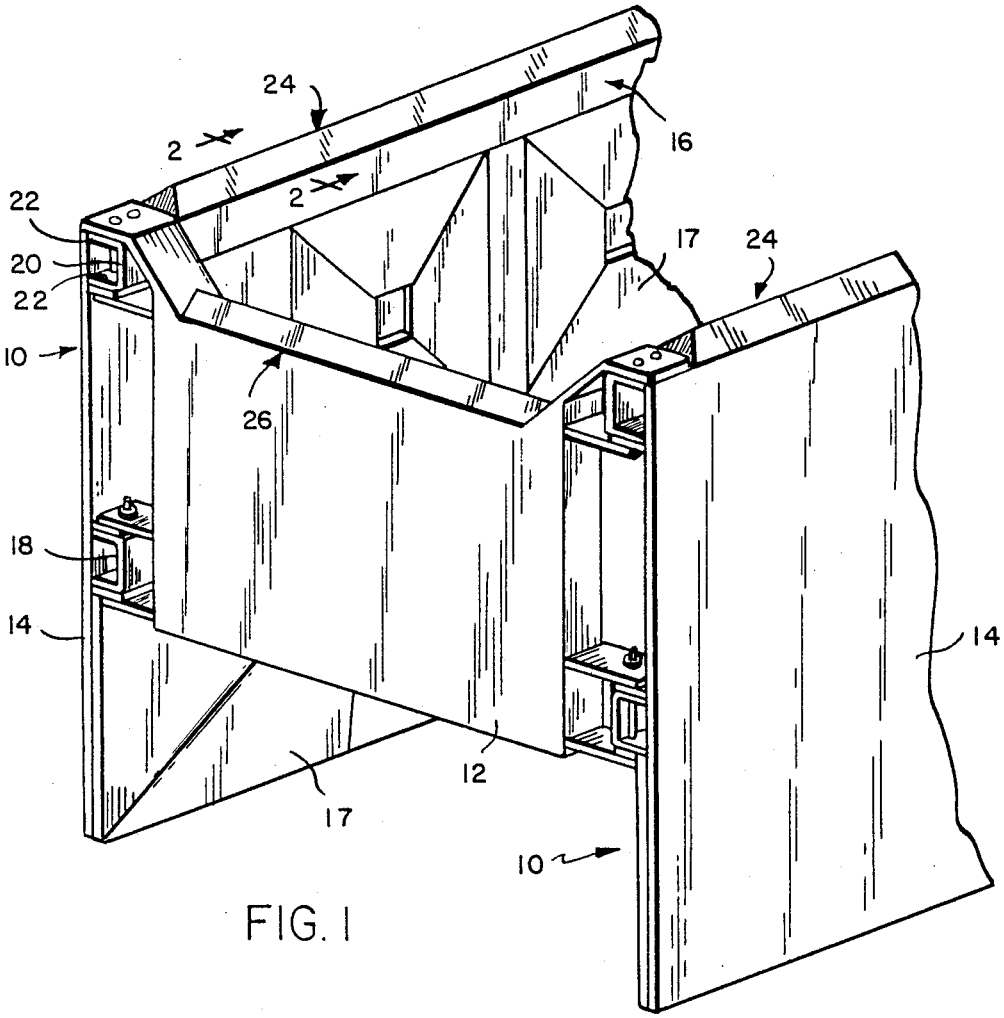
FIG. 1 is a fragmentary perspective of the trench box according to this invention showing an end portion thereof.

In the aforesaid U.S. Pat. No. 4,659,260, there is shown a trench box comprising spaced, parallel side walls 10—10 of generally rectangular configuration held in spaced, parallel relation by transversely-disposed spacers 12—12, one at each end of the respective ends of the spaced, parallel side walls.

Each side wall 10 is comprised of a rectangular sheet 14 of light gauge metal, to the inner side of which is welded vertically-spaced channel members 16 and 18 which extend throughout the length of the wall from end-to-end. The channel 16—16 are located along and parallel to the upper edges of the walls 10 and the channels 18 are welded to the walls in spaced, parallel relation to the upper channels approximately midway between the upper and lower edges. The channels 16 and 18 as disclosed are of rectangular, that is, U-shaped, cross section. Each channel 16 and 18 has a flat rectilinear vertical web 20 and spaced, parallel, horizontal flanges 22—22. Between the channels 16, 18 and below the channels 18 there are reinforcing plates 17.

It has been found in practice that the horizontal upper edges of the side walls 10—10 and the spacers 12—12 which were flat formed shelves at the upper edges of the trench box upon which rocks and large chunks of earth tended to collect until a height was reached wherein the entire amount of the collect fell over into the trench box, with the result that a worker within the trench box could be seriously injured. It is the purpose of this invention to eliminate this dangerous condition by reshaping the upper edges of the side walls 10 and the upper edges of the spacers 12 so that rocks and dirt falling downwardly onto the upper edges will not lodge thereon, but will fall downwardly at the outer or inner sides of the walls before it accumulates in any considerable amount.

Figure 2:
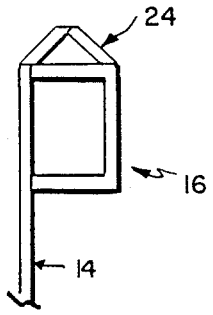
FIG. 2 is a transverse section of a side wall taken on the line 2—2 of FIG. 1 showing a preferred form wherein the upper edge is of triangular cross section.

This is achieved herein in a preferred form, as illustrated in FIGS. 1 and 2, by providing at the upper edges of the side walls 10—10 and the spacers 12—12 capping members 24, 26 of generally triangular cross section such that rocks and/or dirt will not lodge on the upper edges of the side walls and/or spaces, but will descend either to the outside or to the inside of the trench box.

Figure 3:
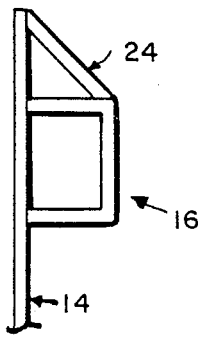
FIG. 3 shows an alternative cross section for the side and end walls wherein the upper edges are inclined inwardly.
Figure 4:
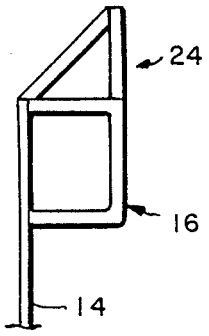
FIG. 4 shows an alternative cross section for the side and end walls wherein the upper edges are inclined outwardly.
Figure 5:
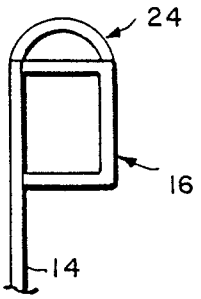
FIG. 5 shows an alternative cross section for the side and end walls of arcuate configuration.

Optionally, the capping members 24, 26 may be inwardly inclined, as shown in FIG. 3, or outwardly inclined, as shown in FIG. 4. The outwardly-inclined upper edges will divert the material toward the outer side while the inwardly-inclined upper edges will divert the material to the inner side. In either case, no considerable amount of accumulation will take place. A further option is to structure the upper edges transversely arcuate, as shown in FIG. 5.

Figure 6:
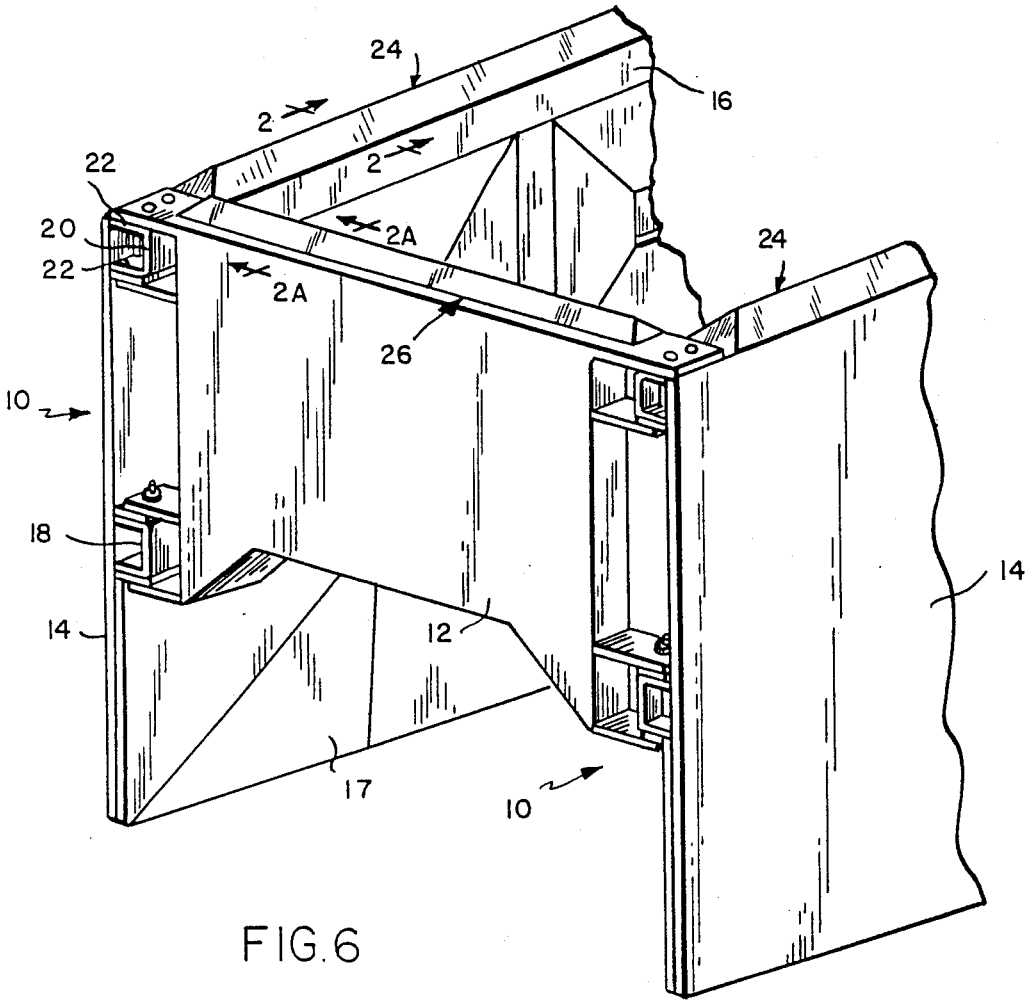
FIG. 6 is a fragmentary perspective of an alternative end structure of the trench box.
Figure 2A:
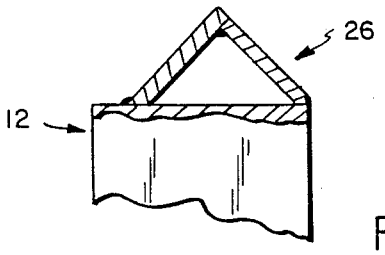
FIG. 2A is a transverse section taken on the line 2A—2A of FIG. 1 at the upper edge of the end wall showing a preferred form wherein the upper edge is of triangular cross section.

The structure shown in FIG. 1 shows the end walls 12 with a depressed upper edge 26. Alternatively, as shown in FIG. 6, the upper edges may be at the same level as the side wall.

In other respects, the trench box of this invention is like that shown in U.S. Pat. No. 4,659,260.

What is claimed is:

1. A trench box comprising spaced, parallel, longitudinally-extending side wall panels of rectangular configuration, vertically-spaced, parallel, longitudinally-extending, U-shaped reinforcing channel members welded to the inner sides of the side wall panels providing vertically-spaced, parallel supports disposed at right angles to the side wall panels, longitudinally-spaced, transversely-disposed end wall panels disposed between the side wall panels holding said side wall panels spaced apart in spaced, parallel relation, and vertically-spaced means at the ends of the transverse panels pivotally connected to said vertically-spaced, parallel supports for pivotally connecting the ends of the side wall panels to the end wall panels, characterized in that there are diverting structures longitudinally of the upper edges of the side wall panels and the upper edges of the end wall panels exclusively of the lower edges of said side and end wall panels for excluding material from the upper edges of the side wall and end wall panels.

2. A trench box according to claim 1, characterized in that the upper edges of the side wall panels and the spacer panels are transversely of A-shaped cross section.

3. A trench box according to claim 1, wherein the upper edges of the side wall panels and the spacer panels are transversely of truncated triangular cross section.

4. A trench box according to claim 1, wherein the upper edges of the side wall panels and the spacer panels are transversely of arcuate cross section.

5. A trench box according to claim 1, wherein the upper edges of the transversely-disposed spacers are displaced downwardly with respect to the upper edges of the side wall panels.

6. A trench box according to claim 5, wherein the upper edges of the spacer panels are at the same level as the side wall panels.

* * * * *